United States Patent [19]

Ehnström

[11] Patent Number: 4,662,866

[45] Date of Patent: May 5, 1987

[54] ARRANGEMENT FOR CONTROLLING DISCHARGE OF A SEPARATED COMPONENT FROM A CENTRIFUGE

[75] Inventor: Lars Ehnström, Tullinge, Sweden

[73] Assignee: Alfa-Laval AB, Tumba, Sweden

[21] Appl. No.: 804,389

[22] Filed: Dec. 4, 1985

[30] Foreign Application Priority Data

Dec. 12, 1984 [SE] Sweden ..... 8406334

[51] Int. Cl.[4] ..... B04B 13/00

[52] U.S. Cl. ..... 494/1; 494/10; 494/56

[58] Field of Search ..... 494/1, 2, 3, 4, 6, 8, 494/9, 10, 11, 37, 56, 57, 58, 59, 84, 85, 23; 422/72; 210/360.1; 366/184

[56] References Cited

U.S. PATENT DOCUMENTS

| | | | |
|---|---|---|---|
| 3,580,493 | 5/1971 | Jonsson | 494/2 |
| 3,750,940 | 8/1973 | Raymond | 494/3 |
| 3,752,389 | 8/1973 | Raymond | 494/3 |
| 3,960,319 | 6/1976 | Brown | 494/2 |
| 4,151,950 | 5/1979 | Gunnewig | 494/2 |
| 4,411,645 | 10/1983 | Tenthoff | 494/10 |

*Primary Examiner*—Robert W. Jenkins
*Attorney, Agent, or Firm*—Cyrus S. Hapgood

[57] ABSTRACT

In a centrifugal separator, an outlet member (9) is rotatable in the centrifuge rotor (1, 2) in a way such that it may be entrained in rotation by liquid supplied to the rotor. The outlet member (9) has an outlet channel (11) leading from one place within the rotor, where a separated mixture component is present, to a reception place (13) for the mixture component. A first means (19) is arranged to counteract rotation of the outlet member (9) so that a desired relative movement is obtained between the outlet member (9) and the separated mixture component in the rotor which is to be removed. A second means (27–30) senses the magnitude of the force by which the outlet member (9) is counteracting the braking effect of said first means. The first means (19) is connected with the second means (27–30) and arranged to accomplish a desired relative movement between the outlet member (9) and the separated component in the rotor in response to the magnitude of said sensed force.

4 Claims, 1 Drawing Figure

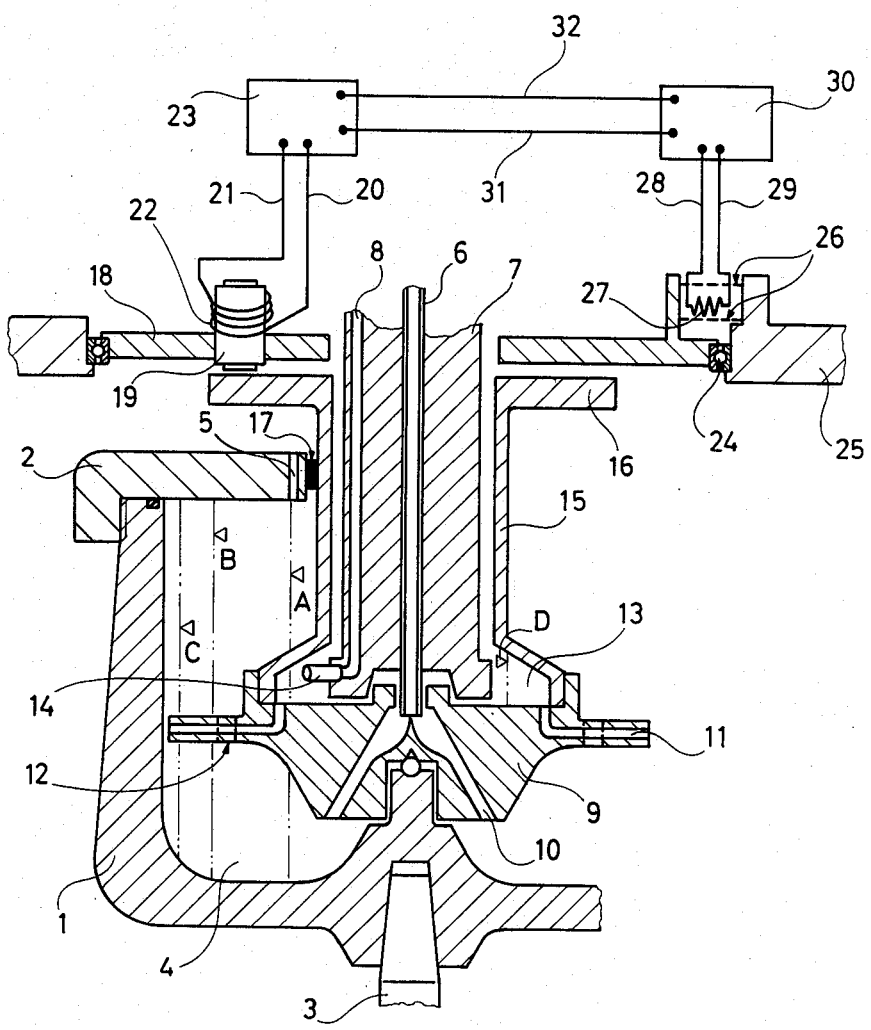
32
23
30
21
20
31
28
29
22
26
18
8
6
7
27
19
24
25
5
17
16
2
15
B
A
D
13
C
14
11
12
9
10
1
4
3

ARRANGEMENT FOR CONTROLLING DISCHARGE OF A SEPARATED COMPONENT FROM A CENTRIFUGE

The present invention relates to centrifugal separators of the kind comprising a rotor with a separation chamber, inlet means for supply of a liquid mixture into the rotor, and outlet means for discharge of at least one separated mixture component from the rotor.

Centrifugal separators of this kind are used for varying purposes, such as the separation of yeast in connection with beer and wine production. The separated yeast, as a rule, is then discharged in a continuous stream from the radially outermost part of the rotor separation chamber, whereby it is most easily ensured that the yeast will not be separated to an extent such that outlet channels in the rotor for the discharge of the yeast from the separation chamber are clogged by yeast which is too concentrated.

A problem in this connection is that the concentration of yeast in the mixture supplied to the rotor may vary, and this leads to a varying composition of the separated yeast discharged from the rotor.

One object of the invention, therefore, is to provide an arrangement by which a separated mixture component, such as yeast, can be removed from a centrifugal separator of the above-described kind with substantially a constant concentration independent of variations in the concentration of the component in the mixture supplied to the centrifugal separator.

Another object of the invention is to provide in such a centrifugal separator an arrangement for intermittent discharge of a separated mixture component from the rotor without encountering the risk of clogging outlet channels in the rotor.

According to the invention, a centrifugal separator of the above-described kind comprises a rotatable outlet member so arranged that it is entrained in rotation by at least one mixture component present within the rotor; a channel extending through the outlet member from a place within the rotor, where the separated mixture component is situated during operation of the rotor, to a reception place therefor; first means for counteraction of the entrainment of the outlet member by said mixture component, so that a desired difference is obtained between the rotational speeds of the outlet member and the separated liquid; and second means for sensing the force needed to counteract the entrainment of the outlet member; said first means further being connected with said second means and arranged to accomplish the desired difference between the rotational speeds of the outlet member and the separated liquid in response to a sensed value of said force.

In a centrifugal separator from which the separated mixture component is to be removed continuously, said first means should be arranged to increase its counteraction of said entrainment when the sensed force is increasing, and to reduce its counteraction of the entrainment when the sensed force is decreasing. In this way the arrangement will be self-controlling.

If the separated mixture component is to be removed intermittently, the first means should instead be arranged to accomplish a predetermined difference between said rotational speeds only when the sensed force reaches a predetermined value.

An arrangement of the last said kind is intended primarily for separation cases where the mixture to be subjected to centrifugation has a very low content of a certain component to be separated. In these cases, part of the component separated within the rotor may become so concentrated in the separation chamber of the rotor, before a sufficient amount of the component has been separated for discharge from the rotor, that it would have a poor fluidity. This can be overcome by the invention, since a difference obtained between the rotational speeds of the outlet member and the separated component leads to a substantial pumping pressure in the channel through the outlet member.

The invention is described more fully in the following with reference to the accompanying drawing, in which the single illustration is a sectional view, partly schematic, of one embodiment of the invention.

In the drawing, a centrifuge rotor consists of two parts 1 and 2. The rotor is supported by a vertical drive shaft 3 which is connected with the lower rotor part 1. Within the rotor is a separation chamber 4 having an overflow outlet in the form of a number of openings 5 in the upper rotor part 2.

Extending axially into the rotor is a stationary inlet pipe 6 surrounded by an outlet member 7 which is also stationary. Through the outlet member 7 one or more outlet passages 8 extend.

Within the rotor there is journalled a rotatable outlet member 9. This has a number of channels 10 arranged to receive a liquid mixture from the inlet pipe 6 and to forward it to the separation chamber 4 of the rotor. The outlet member 9 also has a number of outlet channels 11 extending radially inward from the peripheral portion of the outlet member 9 towards the rotor axis. Between the outlet channels 11 the outlet member 9 has a plurality of axially extending through bores 12 which connect upper and lower parts of the separation chamber 4 with each other.

At a distance radially inside the bores 12 the outlet member 9 forms an annular groove 13 which opens toward the axis of the rotor. The outlet channels 11 open into the radially outermost part of the groove 13.

At a level radially inside the openings of the channels 11 into the groove 13 there is situated—within the groove 13—the part of the non-rotatable outlet member 7 which has the inlet openings of the outlet passages 8. Each of these openings is formed by a short piece of tubing 14 supported by the outlet member 7. Each tubing piece 14 is bent such that it can operate as a paring pipe in the groove 13.

The outlet member 9 is also provided with a tubular portion 15 extending out of the rotor and carrying outside the rotor an annular flange 16. At 17 there is shown schematically a bearing arranged between the tubular portion 15 and the rotor part 2.

Carried by an annular plate 18 is a so-called eddy-current brake 19 by means of which the rotational speed of the annular flange 16—and also of the rotatable outlet member 9—may be reduced. Therefore, the flange 16 consists of some suitable metallic material. Wires 20 and 21 are connected to a coil 22 in the eddy-current brake 19 and to a control unit 23.

The plate 18 is carried through bearings 24 by a frame 25, but it is also connected with the frame in a force transferring manner, which is illustrated schematically by means of dotted lines 26. On the connection between the plate 18 and the frame 25 is fastened a strain gage 27 which by lines 28 and 29 is connected with a sensing instrument 30. The location of the strain gage 27 is shown only schematically in the drawing. In practice, it is such that the strain gage is arranged to sense the magnitude of the force transferred between the plate 18 and the frame 25 when the eddy-current brake 19 is activated and gives the flange 16 a reduced rotational speed.

By means of the wires 31 and 32 the sensing instrument 30 is connected with the control unit 23.

In the drawing there are shown by dash-dot lines four radial levels A, B, C and D within the rotor. The arrangement according to the drawing operates in the following manner: Through stationary pipe 6 there is supplied batchwise or continuously a liquid mixture of components to be separated in the rotor. Relatively heavy component is collected at the periphery of the separation chamber, whereas relatively light component is collected nearer to the rotor axis. A free liquid surface of relatively light component is formed at the level A, and upon continued supply of mixture through the pipe 6, separated light component will leave through the openings 5.

When separation chamber 4 is filled, the outlet member 9 is entrained in the rotation of the supplied liquid. If the liquid supply is interrupted, the entrainment will become substantially complete. If a relatively large liquid supply is maintained, the outlet member 9 will rotate with a somewhat lower speed than the liquid in the separation chamber 4. In the latter case there is formed a free liquid surface in the groove 13 at a level somewhat inside the level A but radially outside the tubing pieces 14.

After some time of operation of the rotor, the circuit 20–22 is activated during a short period of time by means of the control unit 23, so that a relatively weak braking force is exerted on the flange 16 by the eddy-current brake 19. A reaction force against the obtained braking will then arise in the connection 26 between the plate 18 and the frame 25, which force is sensed by the strain gage 27 and the instrument 30. The sensed value of the reaction force is a measure of the resistance against rotation relative to the rotor, which the outlet member 9 exerts upon actuation by the eddy-current brake 19, and also a measure of how much heavy component of the mixture supplied to the rotor has been separated in the separation chamber 4. The larger the surface of outlet member 9 being covered by separated heavy component in the separation chamber, the larger the resistance against braking which is exerted by the outlet member, i.e., the larger is the moment to which the flange 16 is subjected upon actuation by the eddy-current brake 19.

The value sensed by the instrument 30 is transferred to the control unit 23. In the control unit 23 the value is compared with a predetermined value. If the sensed value is smaller than the predetermined value, nothing will happen more than that the circuit 20–22 is again deactivated. However, if the sensed value amounts to or exceeds the predetermined value, the circuit 20–22 is activated even stronger than before, so that a predetermined larger braking force than before is exerted on the flange 16. A desired relation will then arise between the rotational speeds of the outlet member 9 and the liquid in the rotor separation chamber 4.

In the latter case an interface layer between separated light component and separated heavy component has moved radially inward to the level B in the separation chamber 4. By the reduction of the rotational speed of outlet member 9 which is obtained by means of the eddy-current brake 19, the absolute pressure will be decreased in the liquid present within the outlet channels 11, and a flow of separated heavy component will occur radially inward through the channels 11 to the groove 13. The liquid surface in the groove 13 then will move radially inward to the level D, so that the tubing pieces 14 will partly be covered by liquid. As a result, separated heavy component will flow out of the rotor through the outlet passages 8 in the non-rotatable outlet member 7.

After a predetermined time the circuit 20–22 is deactivated by means of the control unit 23, so that the rotational speed of outlet member 9 will again increase. This means that part of the separated heavy component which is situated in the groove 13 will flow back radially outward through the channels 11, the liquid surface in the groove 13 then moving to a level radially outside the tubing pieces 14.

During the time when the rotation of outlet member 9 has been counteracted, the interface layer between separated light component and separated heavy component in the separation chamber 4 has moved radially outward to the level C. As can be seen, the inlet openings of the outlet channels 11 at this stage are still situated in the part of the separation chamber 4 that is filled with separated heavy component. Separated light component thus cannot flow in through the channels 11 to the groove 13. At the next occasion when separated heavy component is to be removed from the rotor, there is therefore only heavy component within the channels 11 and the groove 13.

The movement of said interface layer from the level B to the level C can be made directly dependent upon the amount of liquid leaving the rotor. This amount can be determined in any suitable way. For instance, the outlet passages 8 may have calibrated restrictions, which during a predetermined period of time—under the prevailing conditions—will let through a predetermined amount of liquid.

It has been described above how a control arrangement according to the invention operates in connection with intermittent discharge of a separated component from the separation chamber. However, by means of a control unit only somewhat differently designed, the same arrangement may be used for continuous discharge of a separated component.

In connection with continuous discharge, the circuit 20–22 in a starting position is activated in a way such that a predetermined braking effect is exerted on the flange 16. Then a predetermined relative velocity occurs between the outlet member 9 and the liquid within the rotor, corresponding to a certain discharge through the passages 8 of separated heavy component with a certain concentration. At an unchanged concentration of heavy component in the mixture supplied through the pipe 6, an interface layer formed in the separation chamber 4 between the separated components will remain at a predetermined level.

Thereafter, if the concentration of heavy component in the supplied mixture increases, this leads to a displacement radially inward of said interface layer, which causes a larger moment to be exerted on the outlet member 9. This is sensed by the instrument 30. Information about it will be transferred to the control unit 23, which will see to it that the circuit 20–22 is activated stronger than before, so that the braking force on the flange 16 increases. A larger amount of separated component per unit of time will thereby leave the rotor through the channels 11 and the passages 8, until a state of balance has again been obtained.

In a corresponding manner, the control equipment will react on a decrease of the content of heavy component in the supplied mixture, so that a smaller braking force than normal will be exerted on the flange 16.

In the above-described embodiment of the control arrangement according to the invention, the relatively heavy separated mixture component is the one being removed through the outlet members 7 and 9. Of course, the same control arrangement may be used for the removal of a relatively light mixture component separated in the rotor.

I claim:

1. In combination with a centrifugal separator having a rotor (1–2) mounted for rotation on an axis and forming a separating chamber (4), inlet means (6) for supplying a liquid mixture into said chamber, and outlet means (7) for discharging a separated mixture component from the rotor, the improvement comprising a rotatable outlet member (9) positioned to be entrained in rotation by at least one mixture component in the rotor, there being a liquid reception place (13) within the rotor, said outlet member (9) having a channel (11) extending therethrough to said reception place (13) from a position in the rotor where said separated mixture component is situated during operation of the rotor, first means (19) for counteracting the entrainment of said outlet member (9) by said mixture component, thereby creating a desired difference between the rotational speeds of said outlet member (9) and said mixture component, second means (27–30) for sensing the force needed to effect said counteracting of the entrainment of the outlet member, and third means (20–23, 30) interconnecting said first and second means to effect said desired difference in response to a sensed value of said force.

2. The combination of claim 1, in which said first means (19) is operable to increase its counteraction of said entrainment when the sensed force increases and to decrease its counteraction of the entrainment when the sensed force decreases.

3. The combination of claim 1, in which said first means (19) is operable to effect a predetermined difference between said rotational speeds when the sensed force reaches a predetermined value.

4. The combination of claim 3, in which said third means (20–23, 30) includes a control unit (23) operable on said first means (19) to maintain the predetermined difference in rotational speeds during a predetermined period of time.

* * * * *